US010474052B2

(12) United States Patent
Nesher et al.

(10) Patent No.: US 10,474,052 B2
(45) Date of Patent: Nov. 12, 2019

(54) ELECTROPHOTOGRAPHIC COMPOSITION

(71) Applicant: HP Indigo B.V., Amstelveen (NL)

(72) Inventors: Guy Nesher, Nes Ziona (IL); Getahun Biadglin, Beth-She'an (IL); Haim Cohen, Modiin (IL); Tony Azzam, Nazareth (IL); Samer Farran, Nes Ziona (IL); Ilanit Mor, Kiryat Ono (IL); Noam Parvin, Nes Ziona (IL); Albert Teishev, Rishon le-Zion (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/745,035

(22) PCT Filed: Oct. 9, 2015

(86) PCT No.: PCT/EP2015/073392

§ 371 (c)(1),
(2) Date: Jan. 15, 2018

(87) PCT Pub. No.: WO2017/059925

PCT Pub. Date: Apr. 13, 2017

(65) Prior Publication Data

US 2018/0203373 A1 Jul. 19, 2018

(51) Int. Cl.

*G03G 9/13* (2006.01)
*G03G 8/00* (2006.01)
*G03G 9/08* (2006.01)

(52) U.S. Cl.

CPC ..... *G03G 9/131* (2013.01); *G03G 8/00* (2013.01); *G03G 9/081* (2013.01); *G03G 9/13* (2013.01); *G03G 9/133* (2013.01)

(58) Field of Classification Search

CPC ..... G03G 9/13; G03G 9/131; G03G 9/081; G03G 8/00

See application file for complete search history.

(56) References Cited

U.S. PATENT DOCUMENTS 4,250,241 A * 2/1981 Tsubuko ..... G03G 9/133 430/112
5,750,306 A * 5/1998 Faust ..... C08F 265/04 430/114
5,759,734 A * 6/1998 Malhotra ..... B41M 3/12 156/230
6,103,781 A * 8/2000 Li ..... C08F 265/04 430/116
6,346,357 B1 * 2/2002 Pan ..... G03G 9/125 430/115
7,147,981 B2 12/2006 Fujikawa et al.
7,504,441 B2 3/2009 Narayan-Sarathy et al.
7,678,445 B2 3/2010 Dontula et al.
8,124,308 B2 2/2012 Watanabe et al.
8,980,518 B2 3/2015 Roditi et al.
9,115,291 B2 8/2015 Bollard et al.
9,116,450 B2 8/2015 Iio et al.
2007/0105034 A1 * 5/2007 Chatow ..... G03G 9/12 430/114
2013/0288175 A1 * 10/2013 Chun ..... G03G 13/10 430/112
2014/0030651 A1 * 1/2014 Stolin Roditi ..... C09D 11/02 430/114
2014/0296385 A1 * 10/2014 Blondel ..... C08L 23/0869 523/439
2014/0314449 A1 * 10/2014 Roditi ..... G03G 9/16 399/237
2016/0062258 A1 * 3/2016 Cohen ..... G03G 9/131 430/114

FOREIGN PATENT DOCUMENTS

JP 05134470 A * 5/1993
WO WO-2014206492 A1 * 12/2014 ..... G03G 9/13
WO WO 2015/058814 4/2015
WO WO 2015/144212 10/2015

OTHER PUBLICATIONS

International Search Report and Written Opinion for International Application No. PCT/EP2015/073392 dated Jun. 3, 2016, 11 pages.

* cited by examiner

*Primary Examiner* — Christopher D Rodee
(74) *Attorney, Agent, or Firm* — Dierker & Kavanaugh PC

(57) ABSTRACT

The present disclosure relates to an electrophotographic composition that comprises a polymer resin mixture and a liquid carrier. The polymer resin mixture comprises (i) an olefin polymer A having acid and/or ester side groups and a melt index of 22 to 100 g/10 min; and (ii) an olefin polymer B having a melt index of 1 to 20 g/10 min. The olefin polymer B forms 1 to 50 weight % of the polymer resin mixture.

18 Claims, No Drawings

ELECTROPHOTOGRAPHIC COMPOSITION

BACKGROUND

An electrophotographic printing process involves creating an image on a photoconductive surface or photo imaging plate (PIP). The image that is formed on the photoconductive surface is a latent electrostatic image having image and background areas with different potentials. When an electrophotographic ink composition containing charged toner particles is brought into contact with the selectively charged photoconductive surface, the charged toner particles adhere to the image areas of the latent image while the background areas remain clean. The image is then transferred to a print substrate (e.g. paper) either directly or by first being transferred to an intermediate transfer member (e.g. a soft swelling blanket) and then to the print substrate.

DETAILED DESCRIPTION

Before the present disclosure is disclosed and described, it is to be understood that this disclosure is not limited to the particular process steps and materials disclosed in this disclosure because such process steps and materials may vary. It is also to be understood that the terminology used in this disclosure is used for the purpose of describing particular examples. The terms are not intended to be limiting because the scope is intended to be limited by the appended claims and equivalents thereof.

It is noted that, as used in this specification and the appended claims, the singular forms "a," "an," and "the" include plural referents unless the context clearly dictates otherwise.

As used in this disclosure, "carrier fluid", "carrier liquid," "carrier," or "carrier vehicle" refers to the fluid in which polymers, particles, charge directors and other additives can be dispersed to form a liquid electrostatic composition or liquid electrophotographic composition. The carrier liquids may include a mixture of a variety of different agents, such as surfactants, co-solvents, viscosity modifiers, and/or other possible ingredients.

As used in this disclosure, "liquid electrophotographic composition" or "liquid electrostatic composition" generally refers to a composition, which is suitable for use in an electrophotographic or electrostatic printing process. The liquid electrophotographic composition may comprise chargeable particles of a resin dispersed in a carrier liquid. The liquid electrophotographic composition may or may not comprise a colorant.

As used in this disclosure, "co-polymer" refers to a polymer that is polymerized from at least two monomers. The term "terpolymer" refers to a polymer that is polymerized from 3 monomers.

As used in this disclosure, "melt index" and "melt flow rate" are used interchangeably. The "melt index" or "melt flow rate" refers to the extrusion rate of a resin through an orifice of defined dimensions at a specified temperature and load, reported as temperature/load, e.g. 190° C./2.16 kg. In the present disclosure, "melt flow rate" or "melt index" is measured per ASTM D1238-04c Standard Test Method for Melt Flow Rates of Thermoplastics by Extrusion Plastometer. If a melt flow rate of a particular polymer is specified, unless otherwise stated, it is the melt flow rate for that polymer alone, in the absence of any of the other components of the electrostatic composition.

As used in this disclosure, "acidity," "acid number," or "acid value" refers to the mass of potassium hydroxide (KOH) in milligrams that neutralizes one gram of a substance. The acidity of a polymer can be measured according to standard techniques, for example as described in ASTM D1386. If the acidity of a particular polymer is specified, unless otherwise stated, it is the acidity for that polymer alone, in the absence of any of the other components of the liquid toner composition.

As used in this disclosure, "melt viscosity" generally refers to the ratio of shear stress to shear rate at a given shear stress or shear rate. Testing may be performed using a capillary rheometer. A plastic charge is heated in the rheometer barrel and is forced through a die with a plunger. The plunger is pushed either by a constant force or at constant rate depending on the equipment. Measurements are taken once the system has reached steady-state operation. One method used is measuring Brookfield viscosity @ 140° C., units are mPa-s or cPoise, as known in the art. Alternatively, the melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 Hz shear rate. If the melt viscosity of a particular polymer is specified, unless otherwise stated, it is the melt viscosity for that polymer alone, in the absence of any of the other components of the electrostatic composition.

A polymer may be described as comprising a certain weight percentage of monomer. This weight percentage is indicative of the repeating units formed from that monomer in the polymer.

If a standard test is mentioned in this disclosure, unless otherwise stated, the version of the test to be referred to is the most recent at the time of filing this patent application.

As used in this disclosure, "electrostatic printing" or "electrophotographic printing" refers to the process that provides an image that is transferred from a photo imaging plate either directly or indirectly via an intermediate transfer member to a print substrate. As such, the image may not be substantially absorbed into the photo imaging substrate on which it is applied. Additionally, "electrophotographic printers" or "electrostatic printers" refer to those printers capable of performing electrophotographic printing or electrostatic printing, as described above. An electrophotographic printing process may involve subjecting the electrophotographic composition to an electric field, e.g. an electric field having a field gradient of 50-400 V/μm, or more, in some examples 600-900 V/μm, or more.

As used in this disclosure, "substituted" may indicate that a hydrogen atom of a compound or moiety is replaced by another atom such as a carbon atom or a heteroatom, which is part of a group referred to as a substituent. Substituents include, for example, alkyl, alkoxy, aryl, aryloxy, alkenyl, alkenoxy, alkynyl, alkynoxy, thioalkyl, thioalkenyl, thioalkynyl, thioaryl, etc.

As used in this disclosure, "heteroatom" may refer to nitrogen, oxygen, halogens, phosphorus, or sulfur.

As used in this disclosure, "alkyl", or similar expressions such as "alk" in alkaryl, may refer to a branched, unbranched, or cyclic saturated hydrocarbon group, which may, in some examples, contain from 1 to about 50 carbon atoms, or 1 to about 40 carbon atoms, or 1 to about 30 carbon atoms, or 1 to about 10 carbon atoms, or 1 to about 5 carbon atoms, for example.

The term "aryl" may refer to a group containing a single aromatic ring or multiple aromatic rings that are fused together, directly linked, or indirectly linked (such that the different aromatic rings are bound to a common group such as a methylene or ethylene moiety). Aryl groups described in this disclosure may contain, but are not limited to, from 5 to about 50 carbon atoms, or 5 to about 40 carbon atoms, or 5 to 30 carbon atoms or more, and may be selected from, phenyl and naphthyl.

Unless the context dictates otherwise, the terms "acrylic" and "acrylate" refer to any acrylic or acrylate compound. For example, the term "acrylic" includes acrylic and methacrylic compounds unless the context dictates otherwise. Similarly, the term "acrylate" includes acrylate and methacrylate compounds unless the context dictates otherwise.

As used in this disclosure, "varnish" in the context of the present disclosure refers to substantially colourless, clear or transparent compositions substantially free from pigment or other colorants. As the compositions are substantially free from pigment or other colorants, they may be used as varnishes in the methods described in this disclosure without contributing a further subtractive effect on the CMYK inks that would substantially affect the colour of an underprinted coloured image. It will be understood that other effects such as gamut expansion, saturation and brightness nevertheless may be enhanced.

As used in this disclosure, the term "about" is used to provide flexibility to a numerical range endpoint by providing that a given value may be a little above or a little below the endpoint to allow for variation in test methods or apparatus. The degree of flexibility of this term can be dictated by the particular variable and would be within the knowledge of those skilled in the art to determine based on experience and the associated description in this disclosure.

As used in this disclosure, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented in this disclosure in a range format. It is to be understood that such a range format is used merely for convenience and brevity and thus should be interpreted flexibly to include not just the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not just the explicitly recited values of about 1 wt % to about 5 wt %, but also include individual values and subranges within the indicated range. Thus, included in this numerical range are individual values such as 2, 3.5, and 4 and sub-ranges such as from 1-3, from 2-4, and from 3-5, etc. This same principle applies to ranges reciting a single numerical value. Furthermore, such an interpretation should apply regardless of the breadth of the range or the characteristics being described.

As used in this disclosure, wt % values are to be taken as referring to a weight-for-weight (w/w) percentage of solids in the composition, and not including the weight of any carrier fluid present.

The present disclosure relates to an electrophotographic composition comprising a polymer resin mixture and a liquid carrier. The polymer resin mixture comprises (i) an olefin polymer A having acid and/or ester side groups and a melt index of 22 to 100 g/10 min; and (ii) an olefin polymer B having a melt index of 1 to 20 g/10 min. The olefin polymer B forms 1 to 50 weight % of the polymer resin mixture.

The present disclosure also relates to a method of forming a liquid electrophotographic composition. The method comprises melting (i) an olefin polymer A having acid and/or ester side groups and a melt index of 22 to 100 g/10 min; and (ii) an olefin polymer B having a melt index of 1 to 20/10 min. The olefin polymer B forms 1 to 50 weight % of the polymer resin mixture. The polymer resin mixture is allowed to cool and the cooled mixture is ground to form particles. The particles are then dispersed in a liquid carrier.

The present disclosure also relates to a method of electrophotographically printing an image on a substrate. The method comprises electrophotographically printing an electrophotographic ink composition onto a substrate to form an image; and electrophotographically printing an electrophotographic varnish composition as described in the present disclosure over the image.

It has been found that some electrophotographic inks may not have the desired degree of durability, for example, in terms of scratch resistance when printed on certain print substrates. This can sometimes be addressed by applying an electrophotographic varnish over the printed ink. Such varnishes contain polymer resins that can improve the durability of the image, for example, by improving its scratch resistance. However, the motor torque required to eject such varnishes from the print head may be high because of the viscosity characteristics of such varnishes in the print head. In other words, the print motor used to eject such varnishes may need to be operated at a high torque, reducing the cost-effectiveness of the printing process.

It has been found that, by combining an olefin polymer A having acid and/or ester side groups and a melt index of greater than of 22 to 100 g/10 min; and (ii) an olefin polymer B having a melt index of 1 to 20 g/10 min, it is possible to provide an electrophotographic composition that has desirable durability (e.g. scratch resistance) characteristics as well as viscosity characteristics in the print head. Accordingly, the combination may facilitate a reduction in the motor torque required to expel the electrophotographic composition from the print head.

Polymer B

As discussed above, the electrophotographic composition comprises a polymer resin mixture that contains an olefin polymer B having a melt index of 1 to 20 g/min. The olefin polymer B forms 1 to 50 weight % of the polymer resin mixture.

In one example, the olefin polymer B forms 2 to 40 weight % of the polymer resin mixture, for instance, 5 to 35 weight % of the polymer resin mixture. In one example, the olefin polymer B forms 8 to 30 weight %, for instance, 9 to 25 weight %, 10 to 20 weight % or 10 to 15 weight % of the polymer resin mixture.

Without wishing to be bound by any theory, the olefin polymer B is believed to improve the viscosity characteristics of the electrophotographic composition in the print head, such that the motor torque required to eject the electrophotographic composition is reduced. Surprisingly, despite the relative softness of the polymer B, this improvement in motor torque may be achieved while maintaining the electrophotographic composition's durability characteristics.

In one example, the polymer B has a melt index of 1 to 20 g/10 min, for instance, 1 to 9 g/10 or 10 g/10 min. In another example, the polymer B has a melt index of 3 to 8 g/10 min, for instance, 4 to 7 g/10 min. The melt index of the polymer may be related to the melting point and polarity of monomer groups within the polymer.

In one example, the polymer B has a melting point of less than 75 degrees C. In another example, the polymer B has a melting point of 60 to 70 degrees C.

The polymer B may be an olefin copolymer. The amount of ethylene may be 60 to 78 weight % of the polymer B, for example, 65 to 70 weight % of the polymer B. In some examples, the polymer B may be a copolymer of olefin and a monomer containing a polar group. Examples of polar groups include 0- or N-containing functional groups. For instance, the polymer B contains side groups containing amine, ester, ether and/or anhydride functional groups. In one example, the polymer B contains amine, groups, anhydride groups or both ester and ether groups. In an example, the polymer B has repeating units derived from polar monomers, for instance, maleic anhydride or glycidyl methacrylate. The polymer B may contain 0.1 to 10 weight % of units derived from such polar monomers.

In an example, the polymer B is a terpolymer of a) an olefin (e.g. ethylene), b) an acrylic acid (e.g acrylic acid or methacrylic acid) or an acrylate (e.g. acrylate or methacrylate) and c) a polar monomer. The olefin (e.g. ethylene) may form 60 to 78 weight % of the polymer B, for example, 65 to 70 weight % of the polymer B. The acrylic acid (e.g. acrylic acid or methacrylic acid) or acrylate (e.g. acrylate or methyl acrylate) may form 20 to 35 weight % of the polymer B, for example, 22 to 30 weight % of the polymer B. The polar monomer may form the remainder of the polymer B. Examples of suitable polar monomers include monomers containing amine, amide, ester, ether and/or anhydride functional groups. In one example, the polar monomer contains amide, amine, groups, anhydride groups or both ester and ether groups. In an example, the polar monomer is selected from maleic anhydride or glycidyl methacrylate.

In one example, the polymer B is a terpolymer of ethylene, methacrylic acid and glycidyl methacrylate. The amount of ethylene may be 60 to 78 weight % of the polymer B, for example, 65 to 70 weight % of the polymer B. The amount of methacrylic acid may range from 20 to 35 weight % of the polymer B, for example, 22 to 30 weight % of the polymer B. The remainder of the polymer B may be derived from glycidyl methacrylate. In one example, the polymer B comprises 68 weight % ethylene, 24 weight % methacrylic acid and 8 weight % glycidyl methacrylate. The polymer B may contain monomer units derived from a polymer sold under the trademark Lotader® AX8900.

In one example, the polymer B is a terpolymer of ethylene, ethyl acrylate and maleic anhydride. The amount of ethylene may be 60 to 80 weight % of the polymer B, for example, 65 to 70 weight % of the polymer B. The amount of ethyl acrylate may range from 19 to 35 weight % of the polymer B, for example, 20 to 30 weight % of the polymer B. The remainder of the polymer B may be derived from maleic anhydride. In one example, the amount of maleic anhydride may be 0.1 to 5 weight %, for example, 1 to 3 weight %. In one example, the polymer B comprises 70 weight % ethylene, 29 weight % ethyl acrylate and 1.3 weight % maleic anhydride. The polymer B may be sold under the trademark Lotader® 4700. Alternatively, the polymer B may be one or more polymers sold under the trademark Lotader® 5500, Lotader® 4503 and Lotader® 4720.

The polymer B may be soluble or swellable in the liquid carrier. Where the polymer B is swellable, the polymer B may swell by at least 70% when soaked in the liquid carrier at a temperature of 45 degrees C. for 96 hours. The polymer B may swell by at least 70% when soaked in a liquid carrier at a temperature of 45 degrees C. for 24 hours. To determine the amount of swelling, a predetermined mass of the polymer B (fresh) may be immersed in the liquid carrier at a temperature of 45 degrees for a period of time (e.g. 96 or 24 hours). The polymer B may then be removed from the liquid carrier and the mass of the swollen polymer determined. The difference in mass between the swollen and fresh polymer may be expressed as a percentage of the mass of the fresh polymer to provide the percentage swelling. In some examples, the polymer B is soluble in the liquid carrier.

Polymer A

As discussed in this disclosure, the electrophotographic composition comprises a polymer resin mixture containing an olefin polymer A having acid and/or ester side groups and a melt index of 22 to 100 g/10 min.

Without wishing to be bound by any theory, the olefin polymer A is believed to provide the electrophotographic composition with desired durability characteristics (e.g. scratch resistance). It also contains the acid and/or ester groups required for electrophotographic printing.

In one example, the polymer A has a melt index of 23 to 90 g/10 min, for example, 24 to 80 g/10 min. In another example, the polymer A may have a melt index of 25 to 70 g/10 min or 25 to 65 g/10 min.

In one example, polymer A has a melt index of 22 to 50 g/10 min, for example, 23 to 45 g/10 min. In one example, polymer A has a melt index of 23 to 40 g/10 min, for instance, 24 to 35 g/10 min. In one example, polymer A has a melt index of 25 to 30 g/10 min.

In one example, polymer A has a melting point of 50 to 80 g/10 min, for example, 60 to 70 g/10 min.

The polymer A may have a melting point of greater than 78 degrees C., for example, 80 degrees C. or greater. In one example, the polymer A has a melting point less than 100 degrees, for example, less than 98 degrees C. In one example, the polymer A has a melting point of 80 to 95 degrees C., for instance, 80 to 93 degrees C.

The amount of polymer A in the polymer resin mixture may be 50 to 99 weight %, for example, 50 to 95 weight %. In one example, the amount of polymer A in the polymer resin mixture may be 60 to 95 weight %, for instance, 70 to 90 weight %.

In one example, polymer A is a polymer A having a melt index of 22 to 40 g/10 min, for instance, 23 to 35 g/10 min. In one example, the polymer A is a polymer A having a melt index of 24 to 30 g/10 min. The polymer A may form 70 to 95 weight %, for instance, 80 to 90 weight % of the polymer resin mixture.

The polymer resin A may comprise a thermoplastic polymer (sometimes referred to as a thermoplastic resin). The polymer A is an olefin polymer comprising acid or ester side groups. The acid groups may be derived from acrylic acid (e.g. acrylic acid or methacrylic acid). The ester groups may be derived from acrylates (e.g. acrylate or methacrylate). In one example, the polymer is a polymer of an olefin (e.g. ethylene) and an acrylic acid (e.g. acrylic acid or methacrylic acid) or acrylate (e.g. acrylate or methacrylate).

In one example, polymer A is a polymer of an olefin (e.g. ethylene) and at least one monomer selected from an acrylic or acrylate monomer, for instance, methacrylic acid, acrylic acid, acrylate and methacrylate. The polymer A may comprise at least 80 weight % olefin (e.g. ethylene), for example, 80 to 90 weight % olefin (e.g. ethylene). The polymer A may include 10 to 20 weight % of an acrylic or acrylate monomer, for example, at least one of methacrylic acid, acrylic acid, acrylate and methacrylate.

In one example, the polymer A is a polymer of an olefin (e.g. ethylene) and methacrylic acid. The polymer A may include 80 to 90 weight % ethylene and 10 to 20 weight % methacrylic acid. The polymer A may include 85 weight % ethylene and the remainder methacrylic acid. In one example, the polymer A is or comprises a polymer sold under the trademark Nucrel® 925.

In one example, the polymer A is a polymer of an olefin (e.g. ethylene) and acrylic acid. The polymer A may include 80 to 90 weight % ethylene and 10 to 20 weight % acrylic acid. The polymer A may include 82 weight % ethylene and the remainder acrylic acid. In one example, the polymer A is or comprises a polymer sold under the trademark Nucrel® 2806.

In one example, the polymer resin may include more than one polymer A. In an example, the polymer resin may include 2 or 3 polymer A's. In one example, the polymer resin A may contain a first polymer A' having a melt index of 22 to 40 g/10 min and a second polymer A" having a melt index of 50 to 100 g/10 min. In another example, the polymer resin A may contain a first polymer A' having a melt index of 23 to 30 g/10 min and a second polymer A" having a melt index of 50 to 80 g/10 min. The polymer A' may have a melting point of 85 to 95 degrees C., for instance, 88 to 93 degrees C. The polymer A" may have a melting point of 78 to 85 degrees C., for example, 80 to 83 degrees C.

The polymers A' and A" may be a copolymer of an olefin and an acrylic or acrylate monomer. In one example, the polymer A' may be a copolymer of ethylene and methacrylic acid and polymer A" may be a copolymer of ethylene and acrylic acid.

The amount of A' may be 60 to 80 weight %, for example, 65 to 75 weight % of the polymer resin mixture. The amount of A" may be 15 to 25 weight %, for example, 17 to 22 weight % of the polymer resin mixture. The weight ratio of A' to A may be 2:1 to 5:1, for example, 3:1 to 4:1.

In one example, the polymer A comprises a polymer of an olefin and acrylic acid and a polymer of an olefin and methacrylic acid. In one example, the polymer A is a mixture of Nucrel® 925 (e.g. as polymer A') and Nucrel® 2806 (e.g. as polymer A").

The polymer A may have an acidity of 50 mg KOH/g or more, in some examples an acidity of 60 mg KOH/g or more, in some examples an acidity of 70 mg KOH/g or more, in some examples an acidity of 80 mg KOH/g or more, in some examples an acidity of 90 mg KOH/g or more, in some examples an acidity of 100 mg KOH/g or more, in some examples an acidity of 105 mg KOH/g or more, in some examples 110 mg KOH/g or more, in some examples 115 mg KOH/g or more. The polymer A may have an acidity of 200 mg KOH/g or less, in some examples 190 mg or less, in some examples 180 mg or less, in some examples 130 mg KOH/g or less, in some examples 120 mg KOH/g or less. Acidity of a polymer, as measured in mg KOH/g can be measured using standard procedures known in the art, for example using the procedure described in ASTM D1386.

The acidic side groups may be in free acid form or may be in the form of an anion and associated with one or more counterions, typically metal counterions, e.g. a metal selected from the alkali metals, such as lithium, sodium and potassium, alkali earth metals, such as magnesium or calcium, and transition metals, such as zinc. The polymer A can be selected from resins such as co-polymers of ethylene and an ethylenically unsaturated acid of either acrylic acid or methacrylic acid; and ionomers thereof, such as methacrylic acid and ethylene-acrylic or methacrylic acid co-polymers which are at least partially neutralized with metal ions (e.g. Zn, Na, Li) such as SURLYN® ionomers. The polymer A can be a co-polymer of ethylene and an ethylenically unsaturated acid of either acrylic or methacrylic acid, where the ethylenically unsaturated acid of either acrylic or methacrylic acid may constitute from 5 wt % to about 25 wt % of the co-polymer, in some examples from 10 wt % to about 20 wt % of the co-polymer.

The polymer A may comprise two different polymers having acidic side groups. The two polymers having acidic side groups may have different acidities, which may fall within the ranges mentioned above. The resin may comprise a first polymer having acidic side groups that has an acidity of from 10 mg KOH/g to 110 mg KOH/g, in some examples 20 mg KOH/g to 110 mg KOH/g, in some examples 30 mg KOH/g to 110 mg KOH/g, in some examples 50 mg KOH/g to 110 mg KOH/g, and a second polymer having acidic side groups that has an acidity of 110 mg KOH/g to 130 mg KOH/g.

The ratio of the first polymer having acidic side groups to the second polymer having acidic side groups can be from about 10:1 to about 2:1. The ratio can be from about 6:1 to about 3:1, in some examples about 4:1.

The polymer A may comprise a polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; said polymer may be a polymer having acidic side groups as described in this disclosure. The polymer A may comprise a first polymer having a melt viscosity of 15000 poise or more, in some examples 20000 poise or more, in some examples 50000 poise or more, in some examples 70000 poise or more; and in some examples, the polymer A may comprise a second polymer having a melt viscosity less than the first polymer, in some examples a melt viscosity of 15000 poise or less, in some examples a melt viscosity of 10000 poise or less, in some examples 1000 poise or less, in some examples 100 poise or less, in some examples 50 poise or less, in some examples 10 poise or less. The resin may comprise a first polymer having a melt viscosity of more than 60000 poise, in some examples from 60000 poise to 100000 poise, in some examples from 65000 poise to 85000 poise; a second polymer having a melt viscosity of from 15000 poise to 40000 poise, in some examples 20000 poise to 30000 poise, and a third polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

The polymer A (excluding any other components of the electrostatic composition) may have a melt viscosity of 6000 poise or more, in some examples a melt viscosity of 8000 poise or more, in some examples a melt viscosity of 10000 poise or more, in some examples a melt viscosity of 12000 poise or more. If the resin comprises a plurality of polymers all the polymers of the resin may together form a mixture (excluding any other components of the electrostatic composition) that has a melt viscosity of 6000 poise or more, in some examples a melt viscosity of 8000 poise or more, in some examples a melt viscosity of 10000 poise or more, in some examples a melt viscosity of 12000 poise or more.

Melt viscosity can be measured using standard techniques. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

Polymer Resin Mixture

The polymer resin mixture can constitute about 5 to up to 100%, in some examples about 50 to 99%, by weight of the solids of the liquid electrophotographic composition. The resin can constitute about 60 to 95%, in some examples about 70 to 95%, by weight of the solids of the liquid electrophotographic composition.

The polymer resin mixture can constitute 0.5 to 10 weight %, for example, 1 to 5 weight % or 2 to 4 weight % of the total weight of the liquid electrophotographic composition.

The polymer resin mixture may have a melt viscosity of 6000 poise or more, in some examples a melt viscosity of 8000 poise or more, in some examples a melt viscosity of 10000 poise or more, in some examples a melt viscosity of 12000 poise or more. If the resin comprises a plurality of polymers all the polymers of the resin may together form a mixture (excluding any other components of the electrostatic composition) that has a melt viscosity of 6000 poise or more, in some examples a melt viscosity of 8000 poise or more, in some examples a melt viscosity of 10000 poise or more, in some examples a melt viscosity of 12000 poise or more. Melt viscosity can be measured using standard techniques. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

The polymer resin mixture may comprise an admixture of resin particles of the polymer A and resin particles of the formula B. Alternatively, the polymer resin mixture may comprise composite particles of the polymer A and polymer B. For example, such composite particles may be formed by melting (i) the olefin polymer A and (ii) the olefin polymer B to form a molten polymer resin mixture. The molten polymer resin mixture is allowed to cool, for example, slowly and then ground to form particles. Such particles are composite particles formed from both polymers A and B. It has been found that, by forming such composite particles, closer interactions between polymers A and B can be achieved. This can result in improved characteristics, including, for example, an improvement (i.e. reduction) in the motor torque values required to expel the ink from the print head.

Charge Director

A charge director may be added to the composition. In some examples, the charge director comprises nanoparticles of a simple salt and a salt of the general formula $MA_R$, wherein M is a barium, n is 2, and A is an ion of the general formula $[R_1—O—C(O)CH_2CH(SO_3^-)C(O)—O—R_2]$, where each of $R_1$ and $R_2$ is an alkyl group e.g. as discussed above.

The sulfosuccinate salt of the general formula $MA_n$ is an example of a micelle forming salt. The charge director may be substantially free or free of an acid of the general formula HA, where A is as described above. The charge director may comprise micelles of said sulfosuccinate salt enclosing at least some of the nanoparticles. The charge director may comprise at least some nanoparticles having a size of 10 nm or less, in some examples 2 nm or more (e.g. 4-6 nm).

The simple salt may comprise a cation selected from Mg, Ca, Ba, $NH_4$, tert-butyl ammonium, $Li^+$, and $Al^{+3}$, or from any sub-group thereof. In one example, the simple salt is an inorganic salt, for instance, a barium salt. The simple salt may comprise an anion selected from $SO_4^{2-}$, $PO^{3-}$, $NO_3^-$, $HPO_4^{2-}$, $CO_3^{2-}$, acetate, trifluoroacetate (TFA), $Cl^-$, Bf, F, $ClO_4^-$, and $TiO_3^{4-}$, or from any sub-group thereof. In some examples, the simple salt comprises a hydrogen phosphate anion.

The simple salt may be selected from $CaCO_3$, $Ba_2TiO_3$, $Al_2(SO_4)_3$, $Al(NO_3)_3$, $Ca_3(PO_4)_2$, $BaSO_4$, $BaHPO_4$, $Ba_2(PO_4)_3$, $CaSO_4$, $(NH_4)_2CO_3$, $(NH_4)_2SO_4$, $NH_4OAc$, Tert-butyl ammonium bromide, $NH_4NO_3$, LiTFA, $Al_2(SO_4)_3$, $LiClO_4$ and $LiBF_4$, or any sub-group thereof. In one example, the simple salt may be $BaHPO_4$.

In the formula $[R_1—O—C(O)CH_2CH(SO_3^-)C(O)—O—R_2]$, in some examples, each of $R_1$ and $R_2$ is an aliphatic alkyl group. In some examples, each of $R_1$ and $R_2$ independently is a $C_{6-25}$ alkyl. In some examples, said aliphatic alkyl group is linear. In some examples, said aliphatic alkyl group is branched. In some examples, said aliphatic alkyl group includes a linear chain of more than 6 carbon atoms. In some examples, $R_1$ and $R_2$ are the same. In some examples, at least one of $R_1$ and $R_2$ is $C_{13}H_{27}$.

In an electrophotographic composition, the charge director can constitute about 0.001% to 20%, in some examples 0.01 to 20% by weight, in some examples 0.01 to 10% by weight, in some examples 0.01 to 1% by weight of the solids of the electrostatic composition. The charge director can constitute about 0.001 to 0.15% by weight of the solids of the liquid electrophotographic composition, in some examples 0.001 to 0.15%, in some examples 0.001 to 0.02% by weight of the solids of the liquid electrophotographic composition. In some examples, the charge director imparts a negative charge on the electrostatic composition. The particle conductivity may range from 50 to 500 pmho/cm, in some examples from 200-350 pmho/cm.

Charge Adjuvant

The liquid electrophotographic composition can include a charge adjuvant. A charge adjuvant may be present with a charge director, and may be different to the charge director, and act to increase and/or stabilise the charge on particles, e.g. resin-containing particles, of an electrostatic composition. The charge adjuvant can include, but is not limited to, barium petronate, calcium petronate, Co salts of naphthenic acid, Ca salts of naphthenic acid, Cu salts of naphthenic acid, Mn salts of naphthenic acid, Ni salts of naphthenic acid, Zn salts of naphthenic acid, Fe salts of naphthenic acid, Ba salts of stearic acid, Co salts of stearic acid, Pb salts of stearic acid, Zn salts of stearic acid, Al salts of stearic acid, Cu salts of stearic acid, Fe salts of stearic acid, metal carboxylates (e.g. Al tristearate, Al octanoate, Li heptanoate, Fe stearate, Fe distearate, Ba stearate, Cr stearate, Mg octanoate, Ca stearate, Fe naphthenate, Zn naphthenate, Mn heptanoate, Zn heptanoate, Ba octanoate, Al octanoate, Co octanoate, Mn octanoate, and Zn octanoate), Co lineolates, Mn lineolates, Pb lineolates, Zn lineolates, Ca oleates, Co oleates, Zn palmirate, Ca resinates, Co resinates, Mn resinates, Pb resinates, Zn resinates, AB diblock co-polymers of 2-ethylhexyl methacrylate-co-methacrylic acid calcium, and ammonium salts, co-polymers of an alkyl acrylamidoglycolate alkyl ether (e.g. methyl acrylamidoglycolate methyl ether-co-vinyl acetate), and hydroxy bis(3,5-di-tert-butyl salicylic) aluminate monohydrate. In some examples, the charge adjuvant is aluminium di and/or tristearate and/or aluminium di and/or tripalmitate.

The charge adjuvant can constitute about 0.1 to 5% by weight of the solids of the liquid electrophotographic composition. The charge adjuvant can constitute about 0.5 to 4% by weight of the solids of the liquid electrophotographic composition. The charge adjuvant can constitute about 1 to 3% by weight of the solids of the liquid electrophotographic composition.

Carrier Liquid

Generally, the carrier liquid for the liquid electrophotographic composition can act as a dispersing medium for the other components in the electrostatic composition. For example, the carrier liquid can comprise or be a hydrocarbon, silicone oil, vegetable oil, etc. The carrier liquid can include, but is not limited to, an insulating, non-polar, non-aqueous liquid that can be used as a medium for toner particles. The carrier liquid can include compounds that have a resistivity in excess of about $10^9$ ohm-cm. The carrier liquid may have a dielectric constant below about 5, in some examples below about 3. The carrier liquid can include, but is not limited to, hydrocarbons. The hydrocarbon can include, but is not limited to, an aliphatic hydrocarbon, an isomerized aliphatic hydrocarbon, branched chain aliphatic hydrocarbons, aromatic hydrocarbons, and combinations thereof. Examples of the carrier liquids include, but are not limited to, aliphatic hydrocarbons, isoparaffinic compounds, paraffinic compounds, dearomatized hydrocarbon compounds, and the like. In some examples, the carrier liquid is an isoparaffinic liquid. In particular, the carrier liquids can include, but are not limited to liquids sold under the trademarks, Isopar-G™, Isopar-H™, Isopar-L™, Isopar-M™, Isopar-K™, Isopar-V™, Norpar 12™, Norpar 13™, Norpar 15™, Exxol D40™, Exxol D80™, Exxol D100™, Exxol D130™, and Exxol D140™ (each sold by EXXON CORPORATION); Teclen N-16™, Teclen N-20™, Teclen N-22™, Nisseki Naphthesol L™, Nisseki Naphthesol M™, Nisseki Naphthesol H™, #0 Solvent L™, #0 Solvent M™, #0 Solvent H™, Nisseki Isosol 300™, Nisseki Isosol 400™, AF-4™, AF-5™, AF-6™ and AF-7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and Electron, Positron, New II, Purogen HF (100% synthetic terpenes) (sold by ECOLINK™).

Before printing, the carrier liquid can constitute about 20% to 99.5% by weight of the electrostatic composition, in some examples 50% to 99.5% by weight of the electrostatic composition. Before printing, the carrier liquid may constitute about 40 to 90% by weight of the electrostatic composition. Before printing, the carrier liquid may constitute about 60% to 80% by weight of the electrostatic composition. Before printing, the carrier liquid may constitute about 90% to 99.5% by weight of the electrostatic composition, in some examples 95% to 99% by weight of the electrostatic composition.

The composition when printed on the print substrate, may be substantially free from carrier liquid. In an electrostatic printing process and/or afterwards, the carrier liquid may be removed, e.g. by an electrophoresis processes during printing and/or evaporation, such that substantially just solids are transferred to the print substrate. Substantially free from carrier liquid may indicate that the ink printed on the print substrate contains less than 5 wt % carrier liquid, in some examples, less than 2 wt % carrier liquid, in some examples less than 1 wt % carrier liquid, in some examples less than 0.5 wt % carrier liquid. In some examples, the ink printed on the print substrate is free from carrier liquid.

Colorants

The electrophotographic composition and/or ink printed on the print substrate may further include a colorant. The colorant may be selected from a pigment, dye and a combination thereof. The colorant may be transparent, unicolor or composed of any combination of available colours. The colorant may be selected from a cyan colorant, a yellow colorant, a magenta colorant and a black colorant. The electrophotographic composition and/or ink printed on the print substrate may include a plurality of colorants. The electrophotographic composition and/or ink printed on the print substrate may include a first colorant and second colorant, which are different from one another. Further colorants may also be present with the first and second colorants. The electrophotographic composition and/or ink printed on the print substrate may include first and second colorants where each is independently selected from a cyan colorant, a yellow colorant, a magenta colorant and a black colorant. In some examples, the first colorant includes a black colorant, and the second colorant includes a non-black colorant, for example a colorant selected from a cyan colorant, a yellow colorant and a magenta colorant. The colorant may be selected from a phthalocyanine colorant, an indigold colorant, an indanthrone colorant, a monoazo colorant, a diazo colorant, inorganic salts and complexes, dioxazine colorant, perylene colorant, anthraquinone colorants, and any combination thereof.

Where present, the colorant may be present in an amount of 0.1 to 10 weight %, for instance, 2 to 5 weight % of the total weight of solids of the composition.

In some examples, the electrophotographic composition is devoid of colorant. The electrophotographic composition may be a varnish composition that is electrophotographically printed over an image formed of an electrophotographic ink.

Printing Process and Print Substrate

As mentioned above, the present disclosure also relates to a method of electrophotographically printing an image on a substrate. The method may comprise electrophotographically printing an electrophotographic ink composition onto a substrate to form an image; and electrophotographically printing an electrophotographic varnish composition as described in the present disclosure over the image.

In some examples, the liquid electrophotographic composition as described in this disclosure is printed onto a substrate using a liquid electrophotographic printer.

In some examples, the surface on which the image is formed or developed may be on a rotating member, e.g. in the form of a cylinder. The surface on which the printed image is formed or developed may form part of a photo imaging plate (PIP). The method may involve passing the composition between a stationary electrode and a rotating member, which may be a member having the surface having the (latent) electrostatic image thereon or a member in contact with the surface having the (latent) electrostatic image thereon. A voltage is applied between the stationary electrode and the rotating member, such that particles adhere to the surface of the rotating member. The intermediate transfer member, if present, may be a rotating flexible member, which may be heated, e.g. to a temperature of from 80 to 160° C.

The print substrate may be any suitable substrate. The substrate may be any suitable substrate capable of having an image printed thereon. The substrate may include a material selected from an organic or inorganic material. The material may include a natural polymeric material, e.g. cellulose. The material may include a synthetic polymeric material, e.g. a polymer formed from alkylene monomers, including, but not limited to, polyethylene and polypropylene, and co-polymers such as styrene-polybutadiene. The polypropylene may, in some examples, be biaxially orientated polypropylene. The material may include a metal, which may be in sheet form. The metal may be selected from or made from, for instance, aluminium (Al), silver (Ag), tin (Sn), copper (Cu), mixtures thereof. In an example, the substrate includes a cellulosic paper. In an example, the cellulosic paper is coated with a polymeric material, e.g. a polymer formed from styrene-butadiene resin. In some examples, the cellulosic paper has an inorganic material bound to its surface (before printing with ink) with a polymeric material, wherein the inorganic material may be selected from, for example, kaolinite or calcium carbonate. The substrate is, in some examples, a cellulosic print substrate such as paper. The cellulosic print substrate is, in some examples, a coated cellulosic print. In some examples, a primer may be coated onto the print substrate, before the electrostatic composition is printed onto the print substrate.

Various examples will now be described.

EXAMPLES

Materials

The physical properties of the resins used in the Examples are as follows:

TABLE 1

| Polymer | Ethylene Content (weight %) | Co-monomer content (weight %) | Melting Point (° C.) | Vicat Softening Point (° C.) | Swelling (% increase in mass when soaked in Isopar ™ at 45° C. for 24 hours) | Melt Index (g/10 min) |
|---|---|---|---|---|---|---|
| Lotader ® AX8900 (Arkema) | 68 | 24 - methacrylic acid, 8 - glycidyl methacrylate | 65 | <40 | Completely dissolved | 6 |
| Lotader ® 4700 (Arkema) | 70 | 29 - ethyl acrylate, 1.3 - maleic anhydride | 65 | <40 | Completely dissolved | 7 |
| Nucrel ®925 (DuPont) | 85 | 15 - methacrylate | 92 | 67 | 21 | 25 |
| Nucrel ®2806 (DuPont) | 82 | 18 - acrylic acid | 83 | 65 | 24 | 60 |
| Bynel ® 2022 (DuPont) | 80 | 10 + 10-methacylate and methacrylic acid | 87 | 58 | 35 | 35 |

TABLE 1b

| Additive | Description |
|---|---|
| Nacure ® XC-269 (King Industries) | Acid Catalyst |
| DECH or 3,4-epoxycyclohexyl 3,4-epoxycyclohexane carboxylate | Small epoxy-based reactive moiety |
| 2-ethylhexyl glycidyl ether | Small epoxy-based reactive moiety |
| Kaolin (Sigma) | Clay filler |

Example 1 (Comparative)

In Example 1, a polymer resin mixture was formed by melting Nucrel®925, Nucrel®2806 and Bynel® 2022 together to form a molten polymer mixture. The mixture was allowed to cool gradually. The resulting mixture was then ground into particles and dispersed in a liquid carrier (isoparaffinic liquid sold under the trademark Isopar™). The weight ratio of Nucrel®925:Nucrel®2806:Bynel®2022 in the composite particles was 78:18:10. The particles were dispersed in a liquid carrier (Isopar™). The concentration of polymer in the resulting liquid electrophotographic composition was 8.4 weight %. The viscosity of the composition was measured using an Arizona Instrument AZI MAX 2000XL Moisture Analyzer. The peak and average motor torque required to eject the composition was also determined using a sensor attached to the BID motor. The results are shown in Table 2 below. As can be seen from the Table, the composition was viscous and could only be ejected by operating the print motor at relatively high torque.

Examples 2 and 3

Compositions were prepared according to Example 1. However, in addition to the composite particles formed from Nucrel®925: Nucrel®2806: Bynel®2022, particles of Lotader®AX8900 (Example 2) and Lotader®4700 (Example 3) were dispersed in the composition. The particles of Lotader®AX8900 and Lotader® 4700 formed 10 weight % of the total weight of particles in the overall composition. As can be seen from Table 2, the compositions of Examples 2 and 3 were less viscous than the composition of Example 1. The compositions of Examples 2 and 3 could also be expelled at lower motor torques.

Examples 4 to 7

Example 1 was repeated. However, in addition to the composite particles formed from Nucrel®925: Nucrel®2806: Bynel®2022, further additives (Nacure® XC-269 (King Industries), 2-ethylhexyl glycidyl ether, 3,4-epoxycyclohexyl 3,4-epoxycyclohexane carboxylate, kaolin) were dispersed in the carrier liquid. Specifically, in Example 4, the composite particles formed from Nucrel®925: Nucrel®2806: Bynel®2022 were mixed with a mixture of Nacure® XC-269 (King Industries), 2-ethylhexyl glycidyl ether and 3,4-epoxycyclohexyl 3,4-epoxycyclohexane carboxylate. Each additive component formed 0.5, 2.5 and 2.5 weight %, respectively of the total weight of composite particles and additives in the composition.

In Example 5, the composite particles formed from Nucrel®925: Nucrel®2806: Bynel®2022 were mixed with a mixture of Nacure® XC-269 (King Industries), 2-ethylhexyl glycidyl ether and 3,4-epoxycyclohexyl 3,4-epoxycyclohexane carboxylate. Each additive component formed 0.5, 10 and 10 weight %, respectively of the total weight of composite particles and additives in the composition.

In Example 6, the composite particles formed from Nucrel®925: Nucrel®2806: Bynel®2022 were mixed with kaolin, whereby kaolin formed 2.5 weight % of the total weight of composite particles and additives in the composition.

In Example 7, the composite particles formed from Nucrel®925: Nucrel®2806: Bynel®2022 were ground with 3,4-epoxycyclohexyl 3,4-epoxycyclohexane carboxylate, the latter forming 25 weight % of the total weight of composite particles and additives in the composition.

As can be seen from Table 2 below, the addition of these additives did not significantly improve the viscosity or motor torque characteristics of the composition.

Example 8

Example 1 was repeated. However, instead of Bynel®2022, the composite particles were formed from Nucrel®925: Nucrel®2806: Lotader®AX8900. As can be seen from Table 2 below, the use of Lotader®AX8900 in the composite particles greatly improved the viscosity and motor torque characteristics of the composition.

Examples 9 and 10

Example 8 was repeated. However, in addition to the composite particles formed from Nucrel®925: Nucrel®2806: Lotader®AX8900, additives (Nacure® XC-269 (King Industries)/2-ethylhexyl glycidyl ether/3,4-epoxycyclohexyl 3,4-epoxycyclohexane carboxylate) were mixed with the composite particles and dispersed in the liquid carrier in the amounts shown in Table 2 below. The addition of additives did not significantly affect the viscosity or motor torque characteristics of the overall composition.

Example 11

Example 1 was repeated. However, the Nucrel®2806 and Bynel® 2022 polymers in the composite particles were replaced with Lotader®AX8900. As can be seen from Table 2 below, the use of Lotader®AX8900 in the composite particles greatly improved the viscosity and motor torque characteristics of the composition.

Examples 12 and 13

Example 11 was repeated. However, in addition to the composite particles formed from Nucrel®925 and Lotader®AX8900, additives [Nacure® XC-269 (King Industries)] were mixed with the composite particles and dispersed in the liquid carrier in the amounts shown in Table 2 below. The addition of additives did not significantly affect the viscosity or motor torque characteristics of the overall composition.

Example 14

Example 1 was repeated. However, instead of Bynel 2022®, the composite particles were formed from Nucrel®925: Nucrel®2806: Lotader®4700. As can be seen from Table 2 below, the use of Lotader® 4700 in the composite particles greatly improved the viscosity and motor torque characteristics of the composition.

TABLE 2

| Example | Formulation tested | Weight ratio of polymers in polymer resin mixture | Average torque while printing (Nm) | Peak torque while printing (Nm) | 8.4% Viscosity (cps) |
|---|---|---|---|---|---|
| 1 | Nucrel ® 925:Nucrel ®:2806 Bynel ® 2022 | 72:18:10 | 1.62 | 1.85 | 170 |
| 2 | Nucrel ® 925:Nucrel 2806 ®:Bynel 2022 ® + 10% Lotader ®AX8900 | "72:18:10" + 10 | 1.56 | 1.65 | 93 |
| 3 | Nucrel ®925:Nucrel ®2806:Bynel ®2022 + 10% Lotader ® 4700 | "72:18:10" + 10 | 1.36 | 1.42 | 53 |
| 4 | Nucrel ®925:Nucrel ®2806:Bynel ®2022 + 0.5/2.5/2.5 Nacure ® XC-269 (King Industries)/ 2-ethylhexyl glycidyl ether/ 3,4-epoxycyclohexyl 3,4-epoxycyclohexane carboxylate | 72:18:10 + additives | 1.59 | 1.83 | 170 |
| 5 | Nucrel ®925:Nucrel ®2806:Bynel ®2022 + 0.5/10/10 Nacure ® XC-269 (King Industries)/ 2-ethylhexyl glycidyl ether/ 3,4-epoxycyclohexyl 3,4-epoxycyclohexane carboxylate | 72:18:10 + additives | 1.5 | 1.64 | 170 |
| 6 | Nucrel ®925:Nucrel ®2806:Bynel ®2022 + 2.5% Kaolin (Sigma) | 72:18:10 + additives | 1.79 | 2.12 | 250 |
| 7 | Nucrel ®925:Nucrel ®2806:Bynel ®2022 + 25% 3,4-epoxycyclohexyl 3,4-epoxycyclohexane carboxylate (by grinding) | 72:18:10 + additives | 2.22 | 2.27 | 300 |
| 8 | Nucrel ®925:Nucrel ®2806:Lotader ®AX8900 | 72:18:10 | 1.3 | 1.4 | 120 |
| 9 | Nucrel ®925:Nucrel ®2806:Lotader ®AX8900 + 0.5/0.5/0.5 Nacure ® XC-269 (King Industries)/ 2-ethylhexyl glycidyl ether/ | 72:18:10 + additives | 1.31 | 1.42 | 120 |

TABLE 2-continued

| Example | Formulation tested | Weight ratio of polymers in polymer resin mixture | Average torque while printing (Nm) | Peak torque while printing (Nm) | 8.4% Viscosity (cps) |
|---|---|---|---|---|---|
| | 3,4-epoxycyclohexyl 3,4-epoxycyclohexane carboxylate | | | | |
| 10 | Nucrel ®925:Nucrel ®2806:Lotader ® AX8900 + 0.5/2.5/2.5 Nacure ® XC-269 (King Industries)/ 2-ethylhexyl glycidyl ether/ 3,4-epoxycyclohexyl 3,4-epoxycyclohexane carboxylate | 72:18:10 + additives | 1.33 | 1.44 | 120 |
| 11 | Nucrel ®925:Lotader AX8900 ® | 90:10 | 1.24 | 1.28 | 60 |
| 12 | Nucrel ®925:Lotader AX8900 ® + 0.5% Nacure ® XC-269 (King Industries) | 90:10 + additives | 1.24 | 1.34 | 60 |
| 13 | Nucrel ®925:Lotader ®AX8900 + 1% Nacure ® XC-269 (King Industries) | 90:10 + additives | 1.33 | 1.43 | 60 |
| 14 | Nucrel ®925:Nucrel ®2806:Lotader ®4700 | 72:18:10 | 1.09 | 1.19 | 10 |

Example 15

Test Method:

As a reference, an unvarnished print circle was printed at 400% coverage. Its scratch resistance was determined using a tungsten carbide tip. The tip was moved across the print circle in a circular movement, scratching the print circle with a predetermined force.

The test was repeated using varnished compositions, whereby an electrophotographic varnish was applied to the unvarnished print circle. The compositions of Examples 1, 8, 9, 11, 12 and 14 were used as varnish compositions. The scratch resistance of each of the varnished print circles was determined using the same method as that employed for the reference.

The scratch resistances of all the varnished print circles were greatly improved (visual inspection) over the scratch resistance of the reference. The scratch resistances of all the varnished print circles were comparable. This indicates that the improvements in viscosity achieved with Examples 8, 9, 11, 12 and 14 over Example 1 did not bring about the expected decrease in durability.

While the methods, print substrates, printing systems and related aspects have been described with reference to certain examples, those skilled in the art will appreciate that various modifications, changes, omissions, and substitutions can be made without departing from the spirit of the disclosure. It is intended, therefore, that the methods, print substrates, printing systems and related aspects be limited by the scope of the following claims. The features of any dependent claim may be combined with the features of any of the independent claims or other dependent claims.

The invention claimed is:

1. A liquid electrophotographic varnish composition consisting of:

a polymer resin mixture consisting of:

(i) an olefin polymer A having acid and/or ester side groups and a melt index of 22 to 100 g/10 min, wherein the olefin polymer A forms 50 to 99 weight % of the polymer resin mixture or a blend of olefin polymers A; and (ii) an olefin polymer B, wherein the olefin polymer B is a terpolymer of a) an olefin, b) an acrylic acid, methacrylic acid, an acrylate, or methacrylate, and c) a polar monomer selected from the group consisting of glycidyl methacrylate and maleic anhydride, wherein the olefin polymer B has a melt index of 1 to 20 g/10 min, and wherein the olefin polymer B forms 1 to 50 weight % of the polymer resin mixture; and a liquid carrier.

2. The composition as claimed in claim 1, wherein the olefin polymer A has a melting point of greater than 78 degrees C. and the olefin polymer B has a melting point of less than 75 degrees C.

3. The composition as claimed in claim 1, wherein the olefin polymer B forms 5 to 25 weight % of the polymer resin mixture.

4. The composition as claimed in claim 1, wherein the olefin polymer B has a melting point of 60 to 70 degrees C.

5. The composition as claimed in claim 1, wherein the olefin polymer B is soluble in the liquid carrier.

6. The composition as claimed in claim 1, wherein the olefin polymer B swells by at least 70% when soaked in the liquid carrier at a temperature of 45 degrees for 96 hours.

7. The composition as claimed in claim 1, wherein the olefin polymer B has a melt index of 1 to 10 g/10 min.

8. The composition as claimed in claim 1, wherein the terpolymer includes ethylene as the olefin, methyl acrylate as the acrylate, and glycidyl methacrylate as the polar monomer.

9. The composition as claimed in claim 1, wherein the olefin polymer A is a copolymer of ethylene and acrylic acid or methacrylic acid.

10. The composition as claimed in claim 1, wherein the olefin polymer A has a melt index of 25 g/10 min to 70 g/10 min.

11. The composition as claimed in claim 1, wherein the blend of olefin polymers A consists of a first polymer having acid and/or ester side groups and a melt index of 22 to 30 g/10 min and a second polymer having acid and/or ester side groups and a melt index of 50 to 80 g/10 min.

12. The composition as claimed in claim 1, wherein the olefin polymer A has an olefin content of 78 to 90 weight % and the olefin polymer B has an olefin content of 60 to 70 weight %.

13. A method of electrophotographically printing an image on a substrate, said method comprising:

electrophotographically printing an electrophotographic ink composition onto the substrate to form an image; and electrophotographically printing the liquid electrophotographic varnish composition according to claim 1 over the image.

14. The composition as claimed in claim 1, wherein the terpolymer includes ethylene as the olefin, the methacrylic acid, and glycidyl methacrylate as the polar monomer.

15. The composition as claimed in claim 1, wherein the terpolymer includes ethylene as the olefin, ethyl acrylate as the acrylate, and maleic anhydride as the polar monomer.

16. The composition as claimed in claim 1, wherein the terpolymer includes:

from 60 to 78 weight % of the olefin;

from about 20 to 35 weight % of the acrylic acid, the methacrylic acid, the acrylate, or the methacrylate; and from about 0.1 to about 10 weight % of the polar monomer.

17. The composition as claimed in claim 1 wherein:

wherein the blend of olefin polymers A consists of a first polymer and a second polymer;

the first polymer is a copolymer of ethylene and methacrylic acid; and the second polymer is copolymer of ethylene and acrylic acid.

18. A method of forming a liquid electrophotographic varnish composition, said method comprising:

melting (i) an olefin polymer A having acid and/or ester side groups and a melt index of 22 to 100 g/10 min; and (ii) an olefin polymer B to form a polymer resin mixture, wherein the olefin polymer B is a terpolymer of a) an olefin, b) an acrylic acid, methacrylic acid, an acrylate, or methacrylate, and c) a polar monomer selected from the group consisting of glycidyl methacrylate and maleic anhydride, wherein the olefin polymer B has a melt index of 1 to 20 g/10 min, and wherein the olefin polymer A forms 50 to 99 weight % of the polymer resin mixture and the olefin polymer B forms 1 to 50 weight % of the polymer resin mixture;

allowing the polymer resin mixture to cool;

grinding the polymer resin mixture to form particles consisting of the olefin polymer A and the olefin polymer B; and dispersing the particles in a liquid carrier to form the liquid electrophotographic varnish composition consisting of the particles and the liquid carrier.

* * * * *